US010431445B2

(12) United States Patent
Nishimura et al.

(10) Patent No.: US 10,431,445 B2
(45) Date of Patent: Oct. 1, 2019

(54) ION ANALYSIS DEVICE

(71) Applicant: HITACHI HIGH-TECHNOLOGIES CORPORATION, Minato-ku, Tokyo (JP)

(72) Inventors: Kazushige Nishimura, Tokyo (JP); Hiroyuki Satake, Tokyo (JP); Masuyuki Sugiyama, Tokyo (JP); Hideki Hasegawa, Tokyo (JP); Tomoyuki Sakai, Tokyo (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 15/763,813

(22) PCT Filed: Oct. 9, 2015

(86) PCT No.: PCT/JP2015/078771
§ 371 (c)(1),
(2) Date: Mar. 27, 2018

(87) PCT Pub. No.: WO2017/061034
PCT Pub. Date: Apr. 13, 2017

(65) Prior Publication Data

US 2018/0286658 A1 Oct. 4, 2018

(51) Int. Cl.
*H01J 49/10* (2006.01)
*H01J 49/16* (2006.01)
(Continued)

(52) U.S. Cl.
CPC ..... *H01J 49/165* (2013.01); *H01J 49/0077* (2013.01); *H01J 49/0445* (2013.01);
(Continued)

(58) Field of Classification Search
CPC .. H01J 49/0077; H01J 49/0445; H01J 49/062; H01J 49/165; H01J 49/26; H01J 49/167
See application file for complete search history.

(56) References Cited

U.S. PATENT DOCUMENTS 5,485,016 A * 1/1996 Irie ..... H01J 49/0422 250/281
5,828,062 A * 10/1998 Jarrell ..... H01J 49/145 250/288

(Continued)

FOREIGN PATENT DOCUMENTS

EP 0655769 A1 11/1994
JP H07-198570 A 8/1995

(Continued)

OTHER PUBLICATIONS https://en.wikipedia.org/wiki/Ion-mobility_spectrometry, retrieved Nov. 28, 2018. (Year: 2018).*

(Continued)

*Primary Examiner* — Wyatt A Stoffa
(74) *Attorney, Agent, or Firm* — Procopio, Cory, Hargreaves & Savitch LLP

(57) ABSTRACT

To reduce contamination of the apparatus with an additive and to quickly switch spraying and stopping of the additive, provided is an ion analyzer including: an ion source for ionizing a measurement target substance, a spray unit for atomizing and spraying toward the measurement target substance a liquid containing an additive that reacts with the measurement target substance; a separation analysis unit for separately analyzing an ion generated by a reaction between the measurement target substance and the additive; a detector for detecting the ion that has been separately analyzed by the separation analysis unit; and a control unit for lowering
(Continued)

a flow rate of the additive supplied to the spray unit during a time when the additive is not necessary.

18 Claims, 10 Drawing Sheets

(51) Int. Cl.
*H01J 49/00* (2006.01)
*H01J 49/04* (2006.01)
*H01J 49/06* (2006.01)
*H01J 49/26* (2006.01)

(52) U.S. Cl.
CPC ..... *H01J 49/062* (2013.01); *H01J 49/167* (2013.01); *H01J 49/26* (2013.01)

(56) References Cited

U.S. PATENT DOCUMENTS 6,323,482 B1 * 11/2001 Clemmer ..... G01N 27/622 250/282
7,642,510 B2 * 1/2010 McEwen ..... H01J 49/0422 250/288
8,648,297 B2 * 2/2014 Chen ..... G01N 30/7266 250/281
9,240,311 B2 * 1/2016 Whitehouse ..... H01J 49/0413
2003/0071209 A1 * 4/2003 Park ..... H01J 49/107 250/288
2004/0046118 A1 * 3/2004 Apffel, Jr. ..... H01J 49/168 250/288
2004/0206901 A1 * 10/2004 Chen ..... G01N 30/7266 250/288
2006/0255261 A1 * 11/2006 Whitehouse ..... H01J 49/0431 250/288
2008/0179511 A1 * 7/2008 Chen ..... H01J 49/0445 250/282
2010/0059674 A1 * 3/2010 Chen ..... H01J 49/045 250/288
2010/0282962 A1 * 11/2010 Machuron-Mandard ..... H01J 49/045 250/282
2013/0260478 A1 * 10/2013 Ewing ..... G01N 33/0057 436/501

FOREIGN PATENT DOCUMENTS

JP 2002-544517 A 12/2002
JP 2009-524036 A 6/2009
JP 2011-522363 A 7/2011
JP 2015-503745 A 2/2015
WO 2000/070335 A2 11/2000
WO 2009/143623 A1 12/2009
WO 2012/146979 A1 11/2012
WO 2013/098616 A1 7/2013

OTHER PUBLICATIONS

International Search Report for related PCT application No. PCT/JP2015/078771, dated Dec. 15, 2015; English translation provided; 2 pages.

* cited by examiner

ION ANALYSIS DEVICE

TECHNICAL FIELD

The present invention relates to an ion analyzer.

BACKGROUND ART

A mass spectrometer and a differential ion mobility spectrometer are apparatuses that analyze a measurement target substance by ionization. In the case of the mass spectrometer, the measurement target substance ion is introduced into a vacuum and then separated in accordance with a mass-to-charge ratio m/z to thereby be detected. An additive used by the mass spectrometer includes a derivatization reagent. The derivatization reagent has an effect to raise ionization efficiency of the measurement target substance by bonding a functional group which can be easily ionized to the measurement target substance. In the case of the differential ion mobility spectrometer, ions are caused to collide with a gas and then the ions are separated in accordance with collision cross sections. The differential ion mobility spectrometer uses an organic solvent such as acetone and acetonitrile as the additive. The organic solvent is vaporized to form a cluster with the measurement target substance ion, by which the collision cross section of the ion is changed. As a result, the difference between the collision cross section of a contaminant ion and that of the measurement target substance ion increases to thereby improve the separability.

The sample to be ionized may take a gas state, a liquid state, or a solid state. To ionize a liquid sample, there is adopted a method in which the liquid is atomized and sprayed by using a spray. In an electro spray ionization method, the liquid sample is caused to flow through a thin tube, and then a high voltage is applied to an outlet of the thin tube. The liquid sample is electrically charged by the high voltage applied to the thin tube, which makes the liquid sample existing near the outlet of the thin tube to be atomized in a mist form by the electrical repulsion. In the electro spray ionization method, a nebulizer gas is caused to flow coaxially with the liquid sample. The liquid sample can be stably sprayed by existence of the nebulizer gas. Solvents in the sprayed charged droplets are vaporized to ionize the measurement target substance contained in the droplets. To ionize the liquid sample, also an atmospheric chemical ionization method may be used. In the atmospheric chemical ionization method, the liquid sample is sprayed, and then the molecules in the air are ionized by electric discharge. After that, the electric charge is moved to the measurement target substance by the ion-molecule reaction, and thus the measurement target substance is ionized.

A mixing method of the additive and a liquid atomization technique used in the mass spectrometer are described below as techniques relating to the present invention.

Patent Document 1 discloses a method in which a substance that alters the characteristics of the measurement target substance ion is mixed into a curtain gas flowing into an inlet of an analyzer constituted by a mass spectrometer and a differential type mobility spectrometer. For altering the characteristics of the measurement target substance ion, there are listed substances as follows: a modifier for altering the collision cross section of the measurement target substance ion; a mass calibration agent as a reference for the mass-to-charge ratio m/z needed for the mass axis calibration; and an exchange reagent for replacing part of the measurement target substance with an isotope. While passing through the curtain gas including the modifier, the mass calibration agent, or the exchange agent, the measurement target substance ion reacts with the agents to be altered in the characteristics thereof.

Patent Document 2 describes a structure in which reagent ions used for a proton transfer reaction (PTR) and an electron transfer dissociation (ETD) are introduced into the mass spectrometer. In the structure depicted, the reagent ions and the carrier gas for the reagent ions are supplied from an ion introduction port of the differential ion mobility spectrometer.

Patent Document 3 describes a method using a liquid chromatography mass analyzer in which the measurement target substance is separated from the contaminants by the liquid chromatography (LC), and then the additive is added to the measurement target substance. In a case where an eluate of a strong anion is used as a separation solvent for the LC, the sensitivity for the measurement target substance may be degraded due to ionization suppression by the eluate. To cope with this, the additive is mixed after LC separation to alter the characteristics of the solvent, thereby ionization suppression with the measurement target substance is prevented and the sensitivity is enhanced.

Patent Document 4 describes a method in which in the electro spray ionization method, a gas is caused to flow through a center of the flow passage of the liquid sample to make finer the particle diameter of the sprayed droplets, thereby efficiently vaporizing the solvent.

Patent Document 5 describes a structure in which the droplets of the sample liquid sprayed by using a spray is mixed with charged droplets generated by the electro spray ionization method, thereby performing simultaneously the operation of liquid-liquid extraction and ionization. The charged droplets serve for extracting the measurement target substance from the sample liquid droplets containing the measurement target substance and contaminants, and also for charging and ionizing the measurement target substance thus extracted. In this method, samples including a lot of contaminants can be analyzed by sequentially performing the liquid-liquid extraction.

Patent Document 6 describes a structure in which a flow passage of the additive is connected to the flow passage of the spray gas used for spraying the liquid sample, thereby mixing the additive. In this method, the flow passages of the liquid sample and the additive are separated, so that the LC in which the liquid sample flows is not contaminated. Further, the additive is prevented from directly reacting with substances in the liquid sample and thus forming salts, the apparatus is less contaminated with salts.

PRIOR ART DOCUMENT

Patent Document

Patent Document 1: JP 2011-522363 A
Patent Document 2: JP 2015-503745 A
Patent Document 3: JP H07-198570 A
Patent Document 4: WO 2012/146979 A1
Patent Document 5: US 2008/0179511 A1
Patent Document 6: JP 2009-524036 A

SUMMARY OF THE INVENTION

Problem to be Solved by the Invention

In the additive mixing method described in Patent Document 1, the additive is mixed with the curtain gas flowing inside the apparatus, so that part of the additive that has not reacted with the measurement target substance ion may diffuse in the apparatus to contaminate the apparatus. When the apparatus is contaminated, the portion through which the measurement target substance ion passes is charged up, resulting in the sensitivity being degraded. Thus, the apparatus needs maintenance. In using the additive mixing method that often causes the apparatus to be contaminated as described, there occurs a problem that the apparatus cannot be operated continuously for a long time. In addition, if the temperature of the flow passage through which the additive flows decreases, the additive is educed to contaminate the flow passage. To prevent this, the entire flow passage needs to be heated. Heating the flow passage of the additive in a wide range involves a problem that the power consumption of the apparatus increases.

The additive mixing method described in Patent Document 2 requires an electrode and a power source for ionizing the additive, which involves a problem that the power consumption increases. Further, the additive ion has a light weight and thus easily diffuses by receiving the air resistance. Due to this, the supply inlet for the additive ion needs to be disposed near the ion introduction port of the mass spectrometer or the differential mobility spectrometer. However, the ion introduction port is a portion to which a contaminant contained in the sample often contacts and thus easily contaminated, which causes a problem that the supply port for the additive ion disposed near the ion introduction port may be contaminated.

In the additive mixing method described in Patent Document 3, the flow passage of the liquid sample is contaminated with the additive. The contamination causes a problem that the robustness of the apparatus may be degraded. When an additive A is to be switched to another additive B, the flow passage that has been contaminated with the additive A needs to be washed, causing a problem that the switching speed is slow. The structure of Patent Document 3 needs to be provided with, at the downstream of the column of the liquid chromatography, a three-way flow passage port in which the additive is mixed and a stirring region for mixing the additive with the measurement target substance. This involves a problem that the measurement target substance may adhere to the three-way flow passage port or the stirring region, resulting in reducing the sensitivity. In addition, the flow after the LC separation is stirred, which causes a problem that the LC separability is degraded.

If the additive is mixed with the structure described in Patent Document 4, the flow passage through which the liquid sample flows is contaminated with the additive. As mentioned above, there arises a problem that the contamination degrades the robustness of the apparatus. Further, when an additive A is to be switched to another additive B, the flow passage that has been contaminated with the additive A needs to be washed, causing a problem that the switching speed is slow. If a liquid chromatography apparatus is connected to the structure of Patent Document 4, the measurement target substance and the additive do not react with each other due to LC separation, resulting in the effect of the additive being degraded.

In the case of the liquid sample containing a lot of contaminants such as blood and urine, the contaminants and the measurement target substance are separated with each other in the liquid chromatography apparatus after a specific retention time inherent to the target substance. If the additive is continuously sprayed by the method described in Patent Document 5, there arises a problem that the additive may introduced into the mass spectrometer at a timing other than the timing corresponding to the retention time, at which the measurement target substance requiring the additive is detected. Further, the additive reacts with not only the measurement target substance requiring the additive but also the measurement target substance which should not be caused to react with the additive. Thus, there is a problem that these measurement target substances contained in the same liquid sample cannot be measured at the same time.

The structure in Patent Document 6 has a problem that the flow passage of the nebulizer gas is contaminated with the additive. Due to this, the additive remaining in the flow passage needs to be removed at the time of switching the additive, which causes a problem that the switching time becomes long.

Means for Solving the Problem

An ion analyzer according to the present invention includes: an ion source for ionizing a measurement target substance; a spray unit for atomizing and spraying toward the measurement target substance a liquid containing an additive that reacts with the measurement target substance; a separation analysis unit for separately analyzing an ion generated by a reaction between the measurement target substance and the additive; a detector for detecting the ion that has been separately analyzed by the separation analysis unit; and a control unit for lowering a flow rate of the additive supplied to the spray unit during a time when the additive is not necessary.

Effect of the Invention

According to the present invention, the apparatus is less contaminated with the additive. Further, the spraying of the additive and stopping can be quickly switched.

Further problems, structure, and effects other than mentioned above will be apparent by referring to the embodiments hereinafter described.

MODES FOR CARRYING OUT THE INVENTION

Embodiments of the present invention are hereinafter described with reference to the drawings.

Embodiment 1

In this embodiment, an additive is mixed with a sample by spraying the additive. A flow passage through which the sample flows is thereby prevented from being contaminated with the additive, which allows an apparatus to have better robustness. Further, the spraying of the additive is stopped at a timing other than when a measurement target substance that requires the additive is being detected, so that the apparatus is less contaminated.

Figure 1:
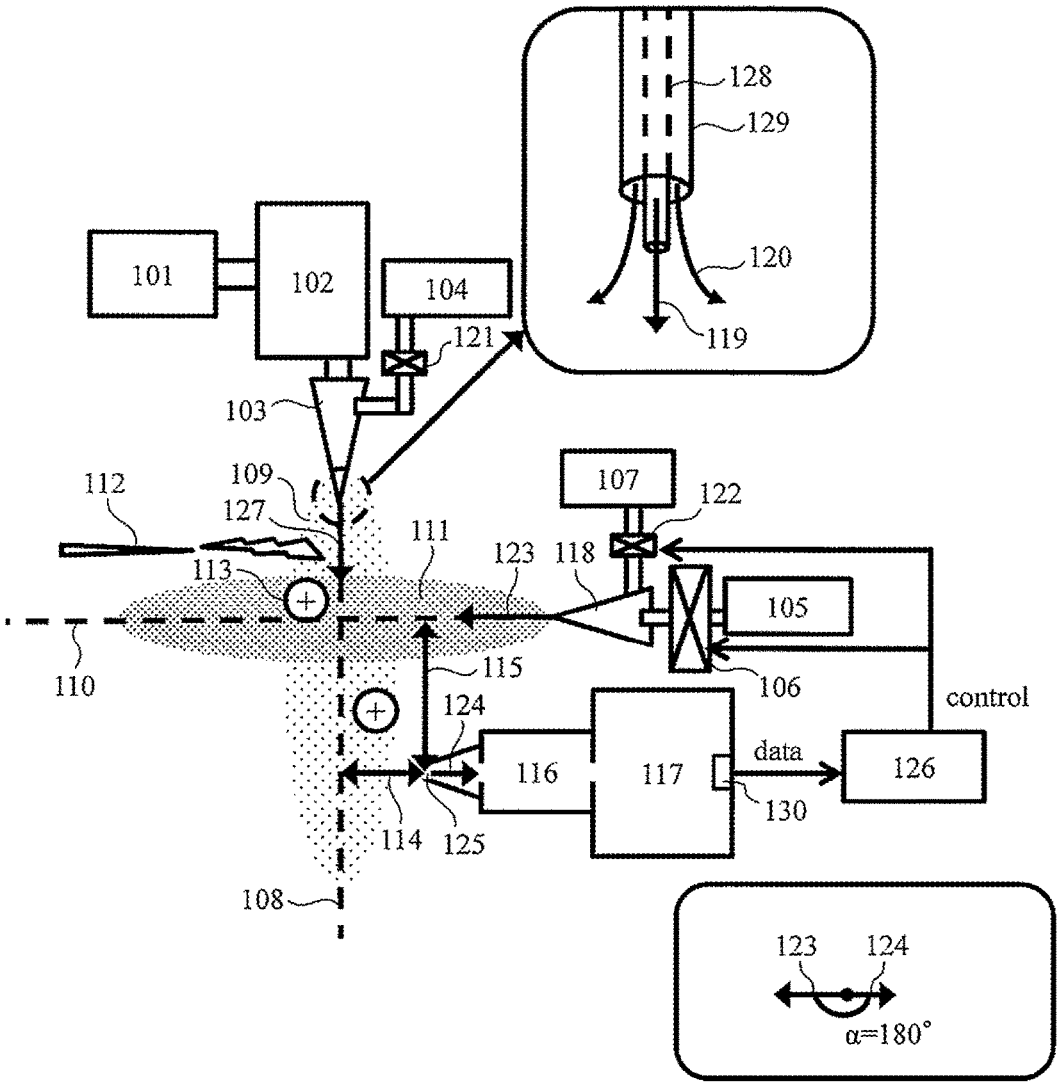
FIG. 1 is a schematic diagram illustrating an exemplary structure of an ion analyzer.

FIG. 1 is a schematic diagram illustrating an exemplary structure of an ion analyzer in the present embodiment. A measurement target substance contained in a liquid sample in a sample container 101 is separated by a liquid chromatography apparatus 102 and then sprayed by a sample spray nozzle 103 after a specific retention time inherent to the target substance. The measurement target substance contained in the sample container 101 may take either one of a gas state, a liquid state, or a solid state. In a case where the sample takes the gas state, a gas chromatography apparatus can be employed in place of the liquid chromatography apparatus 102. Also, other separation means can alternatively be employed in place of the liquid chromatography apparatus 102, and further, it is possible to configure the ion analyzer with no separation means. In the latter case, the apparatus can have a simple structure and be miniaturized as a whole.

The sample spray nozzle 103 has at its distal end a coaxial double cylindrical structure including an inner hollow tube 128 through which a liquid sample 119 flows and an outer hollow tube 129 through which nebulizer gas 120 flows. The liquid sample 119 and the nebulizer gas 120 supplied from a gas cylinder 104 flows coaxially, and then the liquid sample 119 is atomized and sprayed. The solvent in the sprayed liquid sample 109 is thereby volatilized, so that the measurement target substance is vaporized. The vaporized measurement target substance is then ionized by the atmospheric chemical ionization method. The vaporized measurement target substance is ionized by electric discharge generated by a discharging electrode 112, and then moves along a vector 127 defined in a direction in which the sample spray nozzle 103 sprays the liquid sample 119. As the ionization method for an ion source by which the measurement target substance is ionized, other methods can also be employed such as the electro spray ionization method or photoionization method.

Since the flow rate of the nebulizer gas 120 affects the spraying stability and sensibility, a valve 121 is employed to control the flow rate. When the nebulizer gas 120 is heated, volatilization of the solvent is promoted to efficiently vaporize the measurement target substance, which in turn increases the sensibility. When the nebulizer gas 120 is not heated, there is no necessity to supply electricity to the heater, so that the power consumption of the entire apparatus is reduced.

The additive container 105 includes therein a liquid containing the additive. The liquid containing the additive flows through a valve 106 that adjusts the flow rate of the additive and then atomized and sprayed by an additive spray nozzle 118. The additive spray nozzle 118 has a structure similar to that of the sample spray nozzle 103. The nebulizer gas used for spraying the additive flows from a gas cylinder 107 through a valve 122 that adjusts the flow rate of the nebulizer gas and then supplied to the additive spray nozzle 118. After being sprayed to the measurement target substance, the additive 111 reacts with the measurement target substance that has been ionized to thereby change the mass-to-charge ratio m/z and the collision cross section of the ionized measurement target substance. After reacted with the additive, the measurement target substance ion 113 is transported to an ion introduction port 125 of the differential ion mobility separator 116 serving as an ion separator by a voltage applied to the ion introduction port 125. A gas in the ion introduction port 125 is sucked through the differential ion mobility separator 116 by a vacuum pump installed in a mass spectrometer 117. The measurement target substance ion 113 is sucked into the differential ion mobility separator 116 together with the gas along a vector 124 defined in a direction in which the gas is sucked.

The differential ion mobility separator 116 separates the measurement target substance ion 113 by utilizing a nature that the collision cross section of the measurement target substance ion 113 and the gas molecule depends on the electric field intensity and further that the dependency on the electric field is inherent to the substance. An ion mobility separator may alternatively be used in place of the differential ion mobility separator 116. These ion separators change in separability if the mass-to-charge ratio m/z of the measurement target substance ion 113 changes. The measurement target substance ion 113 separated is sucked in the mass spectrometer 117, and then separated in accordance with the mass-to-charge ratio m/z to be detected by a detector 130. A signal indicating the detected ion is processed by a control personal computer 126 serving as a control unit, and if necessary, the valve 106 and the valves 122 are controlled to control the spraying amount of the additive. A control sequence is described later. An ion mobility separator or other separation means may alternatively be used in place of the differential ion mobility separator 116. As the mass spectrometer 117, there can be used a quadrupole filter, an ion trap, a time-of-flight mass spectrometer or the like. The differential ion mobility separator 116 and the mass spectrometer 117 constitute the separation analysis unit of the ion analyzer in the present embodiment.

Sprays used in the sample spray nozzle 103 and the additive spray nozzle 118 employs a technique for atomizing the liquid containing the liquid sample and the additive. In addition to the system illustrated in FIG. 1, the spray system can adopts a pressurizing nozzle system in which the liquid sample is caused to flow into a pore at a high speed, two-fluid nozzle system in which the liquid sample is caused to contact with a pressurized air to thereby be sheared, and the like. In the pressurizing nozzle system, the nebulizer gas 120 is not necessary, so that the apparatus can be miniaturized by omitting the gas cylinder 104. It can also possible to adopt an electro-spray ionization method in which the liquid sample is charged by applying a high voltage to the distal end of the sample spray nozzle 103, thereby atomized and sprayed by the electrical repulsion. Further, any other means may be used as the method for atomizing and spraying the liquid.

The additive container 105 contains therein the additive that changes the mass-to-charge ratio m/z or the collision cross section of the measurement target substance ion. After reacted with the additive, the measurement target substance ion changes in the collision cross section, which in turn enlarges the difference from the collision cross section of a contaminant or a structure isomer, so that the separability of the differential ion mobility separator 116 improves. In addition, the existence of the additive increases the peak of the additive ion as one of fragment ions of the measurement target substance to be detected by the detector 130 of the mass spectrometer 117. Even in a case where many dissociation paths of the measurement substance are present and each of the fragment ions has weak intensity, the additive ions are easily dissociated to have strong intensity. As a result, the measurement target substance can be measured with high sensibility by detecting peaks of additive ions.

For the additive contained in the additive container 105, organic solvents, metal salts, ionic liquids, isotope-exchanging reagents and the like are used. The organic solvents include, for example, 2-propanol, acetone, and octanol. The molecules of the organic solvents are vaporized by being sprayed, and then forms clusters with the measurement target substance ion to change the collision cross section of the measurement target substance ion. Thu clusters are dissociated in the mass spectrometer 117 which has been evacuated, so that the mass-to-charge ratio m/z of the measurement target substance ion to be detected does not change. When the quadrupole filter is used in the mass spectrometer 117, the voltage value applied to the quadrupole filter needs to be changed in accordance with the mass-to-charge ratio m/z. In a case where the organic solvent in which the mass-to-charge ratio m/z measured is not changed is used as the additive, the same condition for the quadrupole filter can be used with any kinds of additives, so that trouble for adjusting parameters can be reduced. The metal salts includes, for example, copper (I) acetate, copper (II) acetate, and manganese chloride. Moreover, any substances, organic or inorganic, may be used as the metal salts as long as it can change the mass-to-charge ratio m/z of the measurement target substance and it can be dissolved in the liquid or the liquid solvent. Polar substances such as the metal salts can be easily dissolved in polar solvents such as water, methanol, and acetonitrile. In contrast, nonpolar substances can be easily dissolved in nonpolar solvents such as hexane and benzene. Depending on the kind of the substance, the pH of the solvent may need to be controlled. Alternatively, a gaseous additive may be caused to bubble and then dissolved in the solvent.

If the additive is mixed on the flow passage of the liquid sample as disclosed in Patent Document 3, the flow passage is contaminated with the additive. The additive mixing method according to the present embodiment can prevent the contamination of the sample passage with the additive by separating a passage through which the sample flows from that through which the additive flows. As a result, the additive does not remains in the sample flow passage, so that the spraying and stopping of the additive can be quickly switched.

When measuring a liquid sample such as blood and urine including many contaminants, periphery of a straight line 108 which extends in the spraying direction of the sample spray using a highly condensed sample liquid droplets and periphery of the ion introduction port 125 of the differential ion mobility separator 116 with which the sample liquid droplets often contact are contaminated. In the mixing method according to the present embodiment, the sprayed additive 111 includes liquid droplets which is heavier than ions and gases and which is less affected by air resistance to have high rectilinearity, so that the contamination of the additive spray nozzle 118 with the sample is reduced by arranging the additive spray nozzle 118 at a position far from a position where the additive spray nozzle 118 is likely to be contaminated with the sample. Further, in the mixing method according to the present embodiment, the sprayed liquid droplet contains the additive in high density and the overall surface area of the liquid droplet is large, so that the ionized measurement target substance and the additive can be efficiently react with each other.

When the liquid chromatography apparatus 102 is used, mixing the additive with the liquid sample in the sample container 101 causes separation between the measurement target substance in the liquid sample and the additive, resulting in no reaction occurring between the measurement target substance and the additive. In the mixing method according to the present embodiment, the additive is mixed after LC separation is performed, so that the sample and the additive are not separated but efficiently react with each other. Here, if the additive is mixed after the LC separation in a manner similar to that described in Patent Document 3, a flow from after the LC separation to the sample spray nozzle 103 is stirred, resulting in the LC separability being degraded. In the mixing method according to the present embodiment, the additive is mixed at downstream with respect to the sample spray nozzle 103, so that it is possible to react the measurement target substance with the additive without degrading the LC separability.

A gas in the ion introduction port 125 is sucked through the differential ion mobility separator 116 by a vacuum pump installed in the mass spectrometer 117, so that not only the measurement target substance ion 113 but also other substances which are not ionized are sucked into the differential ion mobility separator 116 and the mass spectrometer 117. The portion of the gas closer to the ion introduction port 125 is sucked more strongly. Thus, if the shortest distance 114 between a straight line extending along an advancing direction of the ion ionized by the ion source, that is, a straight line 108 extending in a spraying direction of the sample spray, and the ion introduction port 125 is shortened to cause the additive to pass through near the ion introduction port 125, the measurement target substance ion 113 sucked together with the gas into the differential ion mobility separator 116 increases, so that the sensitivity increases. In contrast, if the shortest distance 115 between a straight line 110 extending in a spraying direction of the additive spray and the ion introduction port 125 is extended to cause the measurement target substance to pass through a point far from the ion introduction port 125, the additive sucked together with the gas into the differential ion mobility separator 116 decreases, so that the contamination with the additive is reduced. In other words, setting the distance 115 longer as compared with the distance 114 improves the sensitivity while reducing the contamination.

Further, by spraying the additive in a direction opposite to the ion introduction port 125 of the differential ion mobility separator 116, the additive sucked into the differential ion mobility separator 116 can be reduced and thus the contamination with the additive can be reduced. In other words, if an angle $\alpha$ formed by a vector 123 defined in a direction in which the additive spray nozzle 118 sprays the additive and the vector 124 defined in a direction in which the gas is sucked into the ion introduction port 125 of the differential ion mobility separator 116 becomes larger, the droplets containing the additive are less sucked into the differential ion mobility separator 116, resulting in less contamination. FIG. 1 illustrates a structure in which $\alpha$ is 180 degrees. In this structure, $\alpha$ becomes the largest to less contaminate the apparatus with the additive. The reduction of the contamination is effective where $\alpha$ is 90 degrees or larger. As described above, the spraying directions of the sample spray nozzle 103 and the additive spray nozzle 118 can be set at their suitable directions to reduce the contamination and increase the sensitivity. The position at which the measurement target substance and the additive are mixed is changed in accordance with the directions of the two spray nozzles 103 and 118, so that it is preferable to control flow rates of the liquid sample, the additive, and the nebulizer gas in accordance with the directions of the spray nozzles 103 and 118 to thereby adjust spreads or ranges in spraying.

The liquid sample may contain a substance which requires the additive and a substance or contaminants which should not be caused to react with the additive. These substances are separated by the liquid chromatography apparatus 102, and then detected after retention times different from each other. The control personal computer 126 sets therein as a parameter the retention time of the measurement target substance. The spraying of the additive is stopped at a time other than when the substance requiring the additive is being detected, thereby the contamination of the apparatus can be reduced. Further, even if the liquid sample contains the substance which requires the additive and the substance which should not be caused to react with the additive, it is possible to measure the respective substances at the same time without separating each substance from the liquid sample and separately measuring them by controlling the spraying of the additive.

Figure 2:
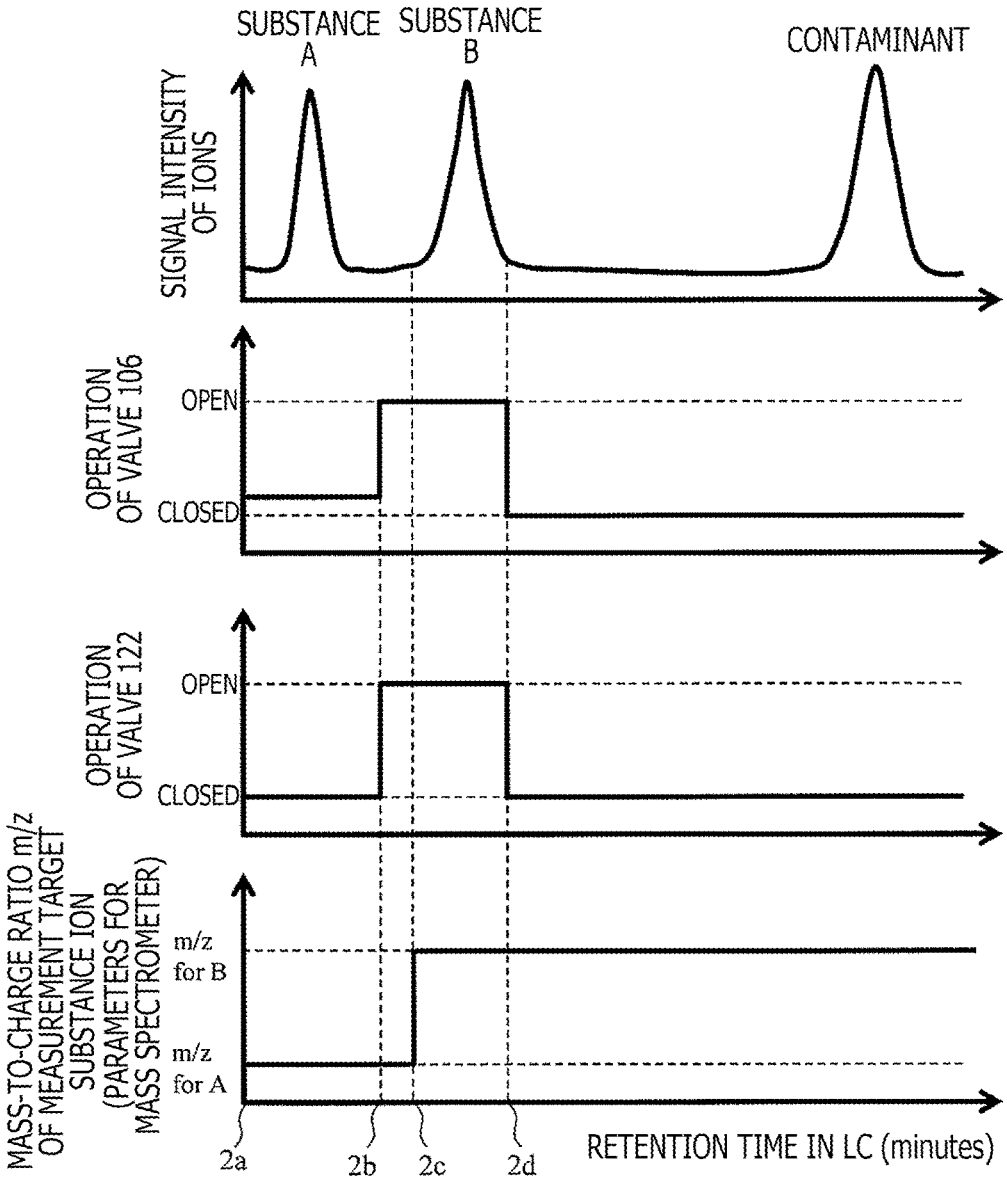
FIG. 2 is a diagram illustrating an example of a flow rate adjusting sequence of an additive.

FIG. 2 is a diagram illustrating an example of a flow rate adjusting sequence of the additive supplied to the additive spray nozzle. In this example, the ion analyzer measures a measurement target substance A with which the additive is not caused to react and a measurement target substance B which requires the additive. Before measurement, the control personal computer 126 sets therein a detection-starting time 2*c* and a detection-ending time 2*d* of the measurement target substance B requiring the additive and a spray-starting time 2*b* of the additive. A time 2*a* indicates the measurement-starting time, that is, zero minutes in the retention time. These times 2*b*, 2*c*, and 2*d* are stored beforehand in a memory of the control personal computer 126. The control personal computer 126 determines times at which the additive is required and not required on the basis of these stored information. The control personal computer 126 controls the valves 106 and 122 of the additive spray such that the additive is sprayed from the additive spray nozzle 118 at a time when the additive is required and the spraying of the additive from the additive spray nozzle 118 is stopped at a time when the additive is not required.

At a time between the measurement-starting time 2*a* and the spray-starting time 2*b*, the valve 106 that adjusts the flow rate of the additive is not fully closed to cause the additive to flow through at a low flow rate. Thus, by continuously supplying the additive to the additive spray at the low flow rate even during a time when the additive is not sprayed, that is, when the additive is not necessary, the flow passage is filled with the additive, so that the stabilization time for the spray is shorten. At this time, the valve 122 that adjusts the flow rate of the nebulizer gas is closed in order that the additive flowing at the low flow rate is not sprayed to the measurement target substance ion. It should be noted that in the case where the valve 106 is fully closed, the stabilization time for the spraying can also be shorten by reducing the volume of the flow passage from valve 106 to the distal end of the additive spray nozzle 118. When the valve 106 is fully closed, the additive stops flowing and the consumption of the additive can be reduced.

The parameters for the mass spectrometer 117 needs to be changed in accordance with the mass-to-charge ratio m/z of the measurement target substance ion. For example, a voltage applied to the electrode is changed for the quadrupole filter. In the case of FIG. 2, the firstly detected substance is the measurement target substance A with which the additive is not caused to react, and the parameters for the mass spectrometer 117 is set in accordance with the mass-to-charge ratio m/z of the ion of the measurement target substance A. At the spray-starting time 2*b*, the valves 106 and 122 are opened to flow the additive and the nebulizer gas, and the additive is sprayed. To stabilize the additive spray, the spray-starting time 2*b* for the additive sprayed by the additive spray is set at a time before the detection-starting time 2*c* of the measurement target substance B requiring the additive. A time between 2*b* and 2*c* for stabilizing the additive is typically one second or more. Depending on the condition of the additive spray, the stabilizing time can be set to one second or less. At the detection-starting time 2*c* of the measurement target substance B requiring the additive, the parameters for the mass spectrometer 117 is changed in accordance with the mass-to-charge ratio m/z of the measurement target substance B requiring the additive. At the detection-ending time 2*d* for the measurement target substance B requiring the additive, the valves 106 and 122 are closed to stop the spraying of the additive. By thus stopping the spraying of the additive at the time in which the additive is not required, the consumption of the additive can be reduced and the contamination of the apparatus with the additive can be prevented. After the detection-ending time 2*d*, nothing but the contaminant is detected, thus the parameters for the mass spectrometer 117 can be set in any manner. Although the parameters for the mass spectrometer 117 are not changed at the time 2*d* in the sequence illustrated in FIG. 2, the voltage applied to the mass spectrometer 117 may be cut off. By cutting off the voltage, the power consumption can be reduced.

Figure 3:
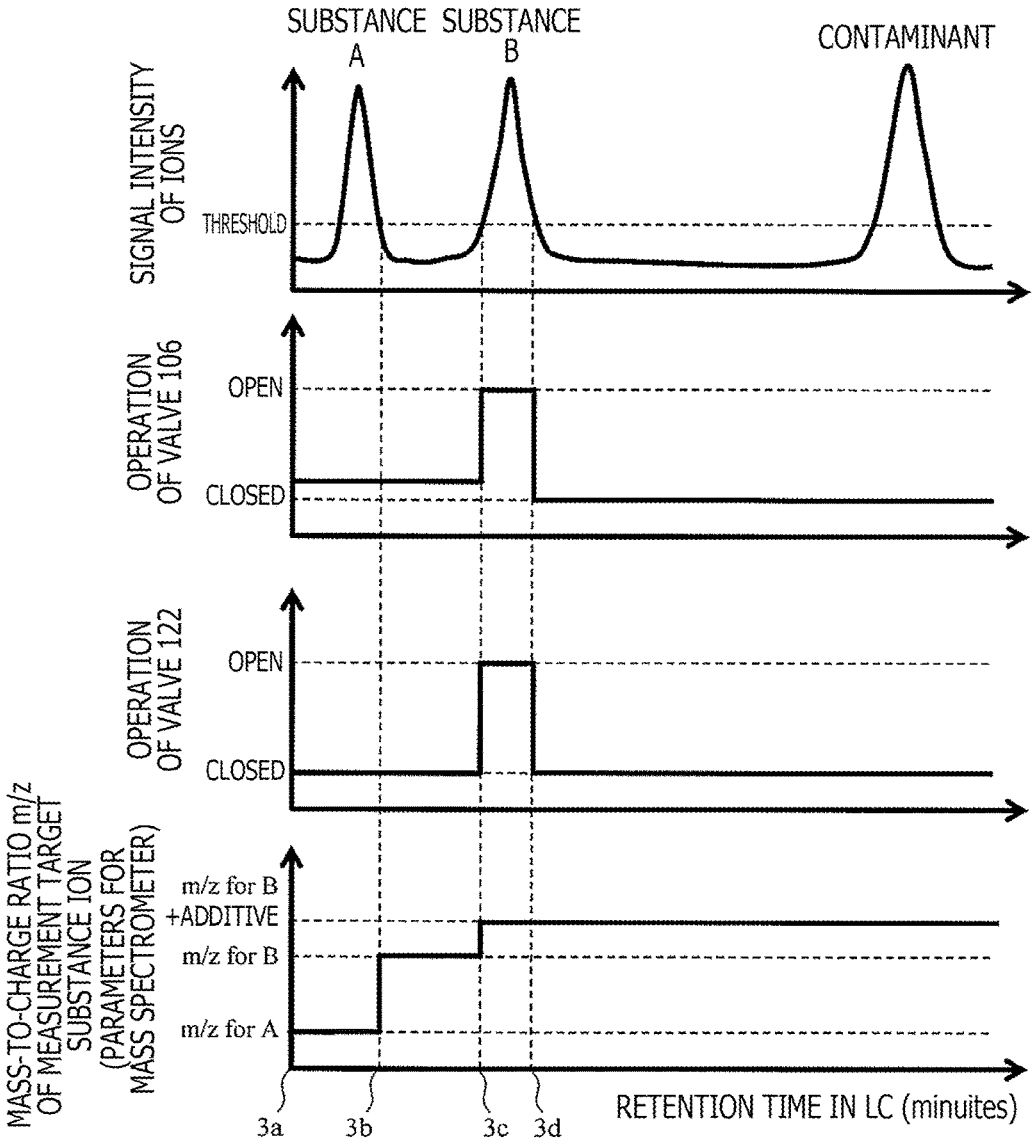
FIG. 3 is a diagram illustrating an example of a flow rate adjusting sequence of an additive.

FIG. 3 is a diagram illustrating an example of a flow rate adjusting sequence of the additive in association with the signal intensity of the measurement target substance ion. In this case, the substance A is a measurement target substance with which the additive is not caused to react, whereas the substance B is a measurement target substance which requires the additive. Before starting the measurement, the control personal computer 126 sets therein a threshold of the signal intensity that determines spraying and stopping of the additive spray. The time 3*a* indicates the measurement-starting time, that is, zero minutes in the retention time. When the analyzation is started, the control personal computer 126 monitors the signal intensity of the ion detected by the detector 130 of the mass spectrometer 117. While the signal intensity of the measurement target substance B requiring the additive is equal to or lower than the preset threshold after the analyzation is started, valve 106 is not fully closed to cause the additive to flow therethrough to thereby fill the additive spray nozzle 118 with the additive in order to shorten the stabilization time for the additive spray. The nebulizer gas is stopped by closing the valve 122 to prevent the additive flowing at a low flow rate from being sprayed to the measurement target substance ion. Besides, the parameters for the mass spectrometer 117 are adjusted in accordance with the mass-to-charge ratio of the measurement target substance A which is to be firstly measured. At the detection-ending time 3*b* for the measurement target substance A with which the additive is not caused to react, that is, at the time 3*b* when the detected signal intensity of the measurement target substance A that has been above the threshold becomes below the threshold, the parameters for the mass spectrometer 117 are set in accordance with the mass-to-charge ratio of the measurement target substance B requiring the additive. At the detection-starting time 3*c* when the signal intensity of the measurement target substance B requiring the additive exceeds the threshold, the valves 106 and 122 are opened to spray the additive. The measurement target substance B has its mass-to-charge ratio m/z be changed when reacts with the additive. For this reason, the parameters of the mass spectrometer 117 are changed at the detection-starting time 3*c*. At the time 3*d* when the signal intensity of the measurement target substance B which has reacted with the additive becomes below the threshold, the valves 106 and 122 are closed to stop supplying the additive and stop supplying the nebulizer gas. Thus, the consumption of the additive can be reduced and the contamination of the apparatus can be prevented.

Embodiment 2

Figure 4:
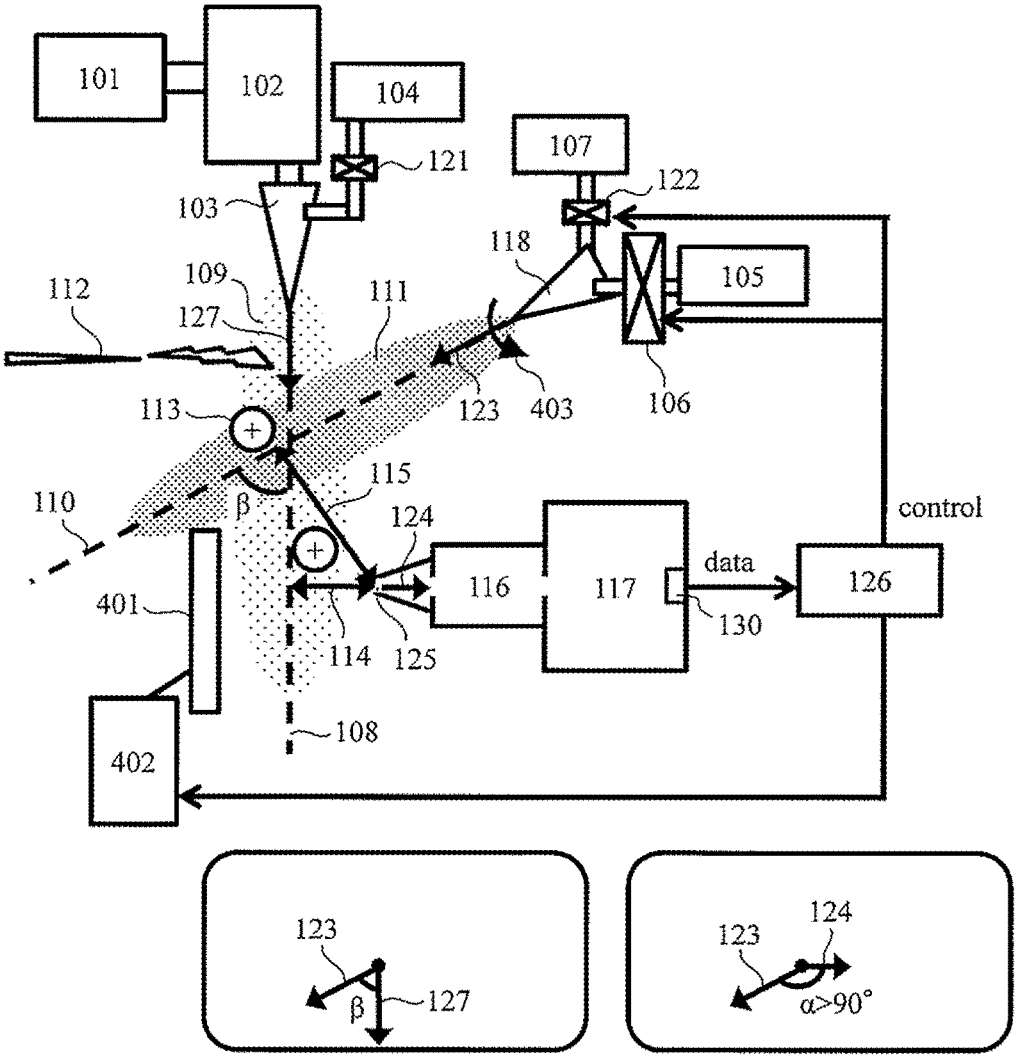
FIG. 4 is a schematic diagram illustrating another embodiment of the ion analyzer.

FIG. 4 is a schematic diagram illustrating another embodiment of the ion analyzer. The present embodiment illustrates a structure which includes a deflector.

When a liquid sample 109 is sprayed from a sample spray nozzle 103, the solvent in the sprayed liquid sample 109 is volatilized to vaporize the measurement target substance. The vaporized measurement target substance is ionized by electric discharge generated by a discharging electrode 112, and then moves in the direction same as the sprayed liquid sample, which direction being the vector 127. The liquid containing the additive is sprayed from an additive spray nozzle 118. The sample spray nozzle 103 and the additive spray nozzle 118 have structure similar to those in Embodiment 1. When the additive is sprayed to the measurement target substance ion, the measurement target substance ion collides with the sprayed additive 111 to receive a force along a vector 123 defined in a direction in which the additive spray nozzle 118 sprays the additive, thereby the advancing direction of the measurement target substance ion is changed. After changing its advancing direction, the measurement target substance ion 113 moves far from the ion introduction port 125, resulting in the sensitivity being reduced. By adjusting the direction of the additive spray nozzle 118 to a direction of an arrow 403 such that an angle β formed by the vectors 123 and 127 becomes smaller, the change of the measurement target substance ion in the advancing direction becomes smaller and the sensitivity increases. At the same time, by setting the direction of the additive spray nozzle 118 such that an angle α formed by a vector 124 defined in a direction in which the gas is sucked into the differential ion mobility separator 116 and the vector 123 becomes 90 degrees or larger, the sprayed additive 111 becomes difficult to enter into the ion introduction port 125, and thus the contamination can be reduced.

A deflector electrode 401 connected to a power source 402 is disposed so as to face the ion introduction port 125 of the differential ion mobility separator 116 which constitutes the separation analysis unit. After reacted with the additive, the measurement target substance ion 113 moves through a clearance between the ion introduction port 125 and the deflector electrode 401. The deflector electrode 401 and the power source 402 serve for bringing back the measurement target substance ion 113 to the ion introduction port 125 by a voltage applied to the deflector 401. The electrically neutral additive which has not reacted with the measurement target substance is not affected by the electric field, so that the deflector electrode 401 enhances the sensitivity for the measurement target substance without increasing the contamination with the additive. A control personal computer 126 controls the power source 402 such that the voltage application to the deflector electrode is synchronized with the spraying time of the additive.

Figure 5:
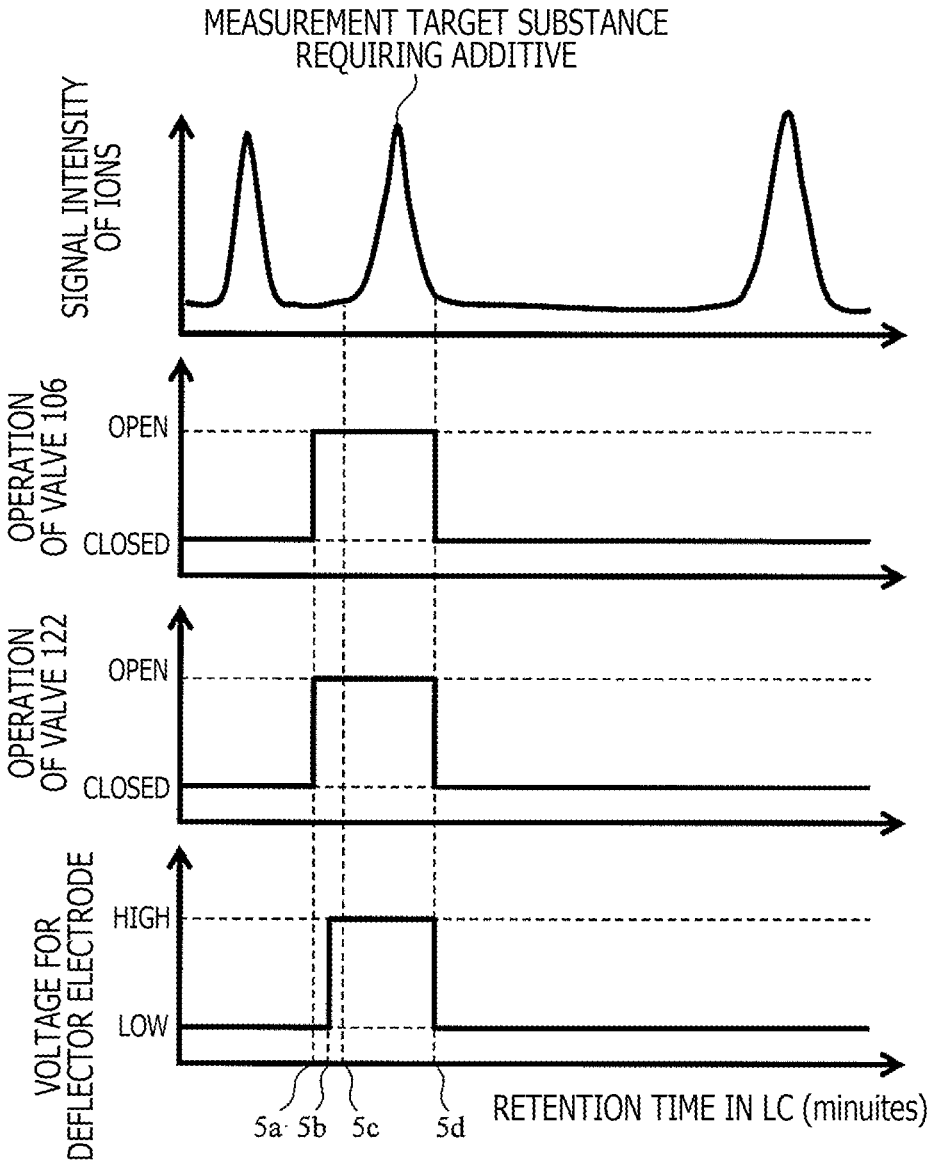
FIG. 5 is a diagram illustrating an example of a controlling sequence of a voltage applied to a deflector electrode.

FIG. 5 is a diagram illustrating an example of a controlling sequence of the voltage applied to the deflector electrode. Before measurement, the control personal computer 126 stores therein as parameters a spray-starting time 5*a* of the additive, a voltage-raising time 5*b* of the deflector electrode, a detection-starting time 5*c* of the measurement target substance, and a detection-ending time 5*d*. At the time 5*a*, valves 106 and 122 are opened to cause the additive and the nebulizer gas to flow, thereby spraying the additive. At the time 5*b*, the voltage of the deflector electrode is raised to transport the measurement target substance ion which has been diffused by the spraying of the additive into the ion introduction port 125. Taking into account the start-up time of the voltage applied to the deflector electrode 401, the voltage-raising time 5*b* is preferably set before the detection-starting time 5*c* of the measurement target substance. To prevent the apparatus from being contaminated with the additive, valves 106 and 122 are closed at the detection-ending time 5*d* of the measurement target substance to thereby stop the spraying of the additive. At the same time, the voltage being applied to the deflector electrode 401 is lowered. The voltage applied to the deflector electrode 401 may be a constant value if no influence exerts on the measurement. If the voltage is set constant, the power source 402 does not have to be controlled, so that the structure can be simplified.

Embodiment 3

In a case where the structure of Embodiment 1 or Embodiment 2 is employed with a plurality of additives being switched, there arises a need for washing operation against the additives remained in the flow passage, causing a problem that it takes time to switch the additives. By preparing a plurality of additive sprays to separate flow passages of the respective additives, the washing operation becomes unnecessary. Thus, the plurality of additives can be switched quickly.

Figure 6:
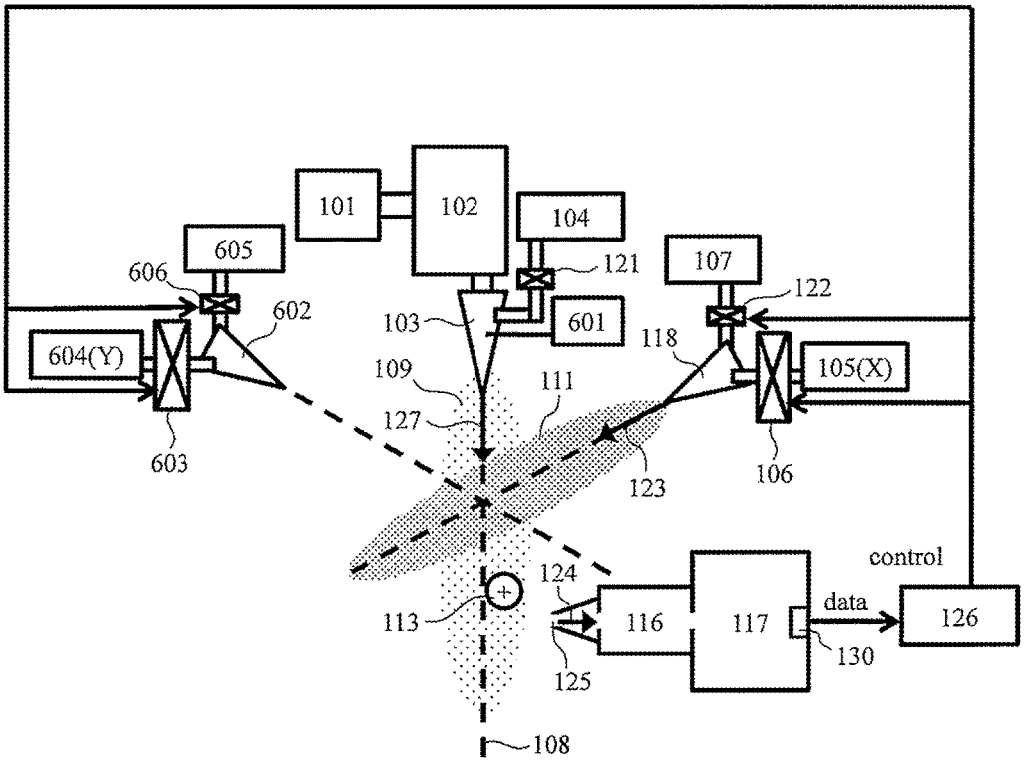
FIG. 6 is a schematic diagram illustrating an exemplary structure of an ion analyzer including two additive sprays.

FIG. 6 is a schematic diagram illustrating an exemplary structure of an ion analyzer including two additive sprays. To simplify the structure around an ion source, the example illustrated in FIG. 6 adopts a structure in which a voltage is applied to a sample spray nozzle 103 by a power source 601, thereby ionizing the measurement target substance by the electro spray ionization method. Depending on the additive, the additive may not react with the measurement target substance if not using the electro spray ionization method. An additive container 105 contains therein a liquid containing an additive X. The liquid containing the additive X flows through a valve 106 that adjusts the flow rate of the additive, and then sprayed by an additive spray nozzle 118. A nebulizer gas used for spraying the additive flows from a gas cylinder 107 through a valve 122 that adjusts the flow rate of the nebulizer gas, and then supplied to the additive spray nozzle 118. An additive Y is sprayed in a similar manner. An additive container 604 contains therein a liquid containing the additive Y. A liquid containing the additive Y flows through a valve 603 that adjusts the flow rate of the additive, and then sprayed by an additive spray nozzle 602. A nebulizer gas used for spraying the additive flows from a gas cylinder 605 through a valve 606 that adjusts the flow rate of the nebulizer gas, and then supplied to the additive spray nozzle 602. By preparing a plurality of additive spray nozzles to separate flow passages of the respective additives, the washing operation against the additives remained in the flow passage becomes unnecessary. Thus, the plurality of additives can be switched quickly.

FIG. 6 illustrates the structure in which two additive sprays are provided, however, three or more additive sprays may also be provided. The more additive sprays being provided, the more kinds of additives can be switched quickly. It should be noted that FIG. 6 illustrates such that the additive sprayed from the additive spray nozzle 602 advances toward an ion introduction port 125 of a differential ion mobility separator 116 constituting a separation analysis unit, but this is a matter of convenience. Actually, the plurality of additive spray nozzles are disposed in a three-dimensional manner while each of the additive spray nozzles satisfying the conditions described in Embodiment 1 or Embodiment 2.

Figure 7:
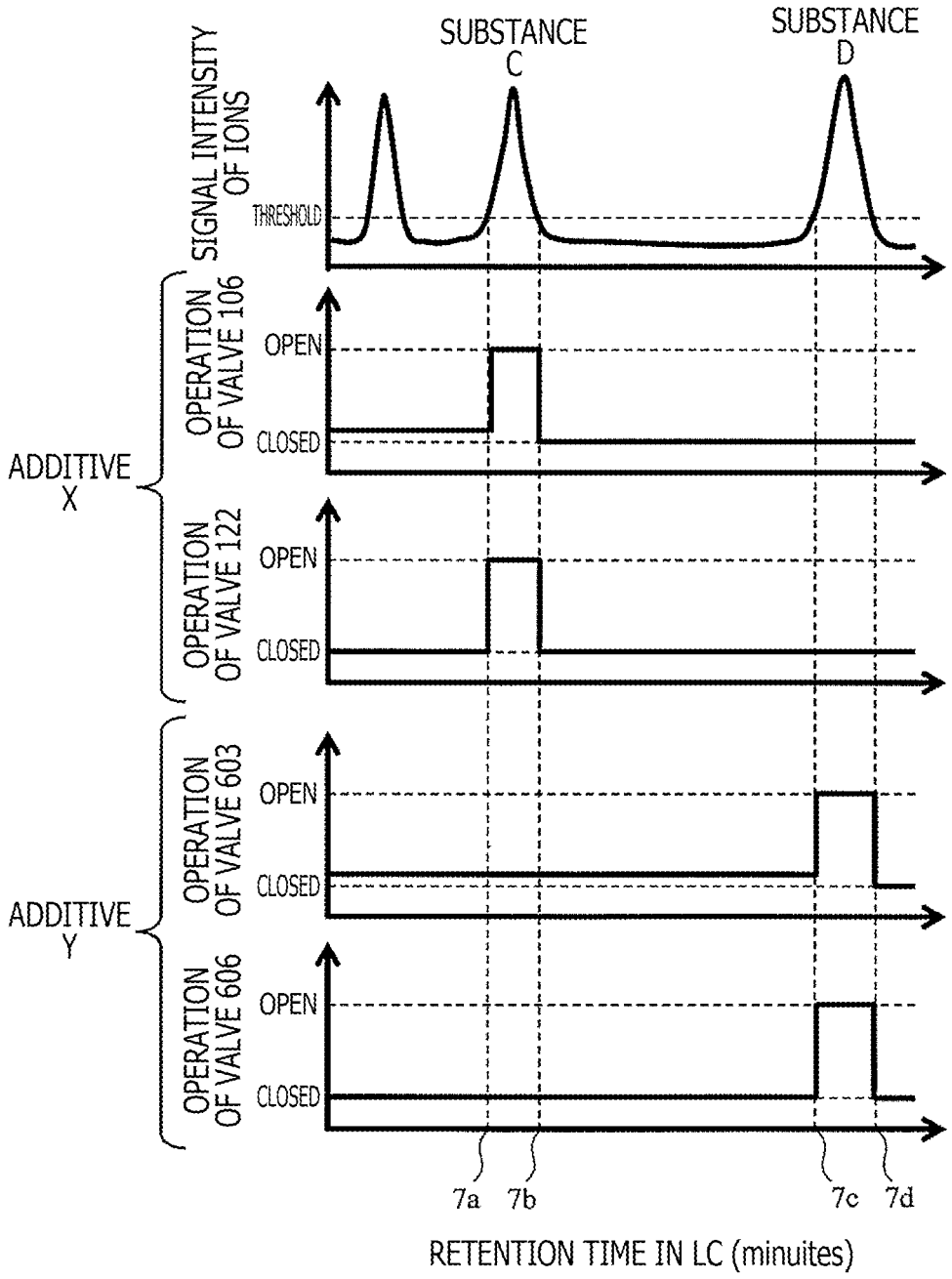
FIG. 7 is a diagram illustrating an example of a switching sequence of additives.

FIG. 7 is a diagram illustrating an example of a switching sequence of the additives. Here described is an example in which a control personal computer 126 monitors the signal intensity of the ion detected by a detector 130 of the mass spectrometer 117 to control the valve of each additive spray on the basis of the comparison result with a preset threshold. To quickly switch the additive sprays, the valves 106 and 603 are not fully closed and the additive X and the additive Y are caused to flow continuously at low flow rates such that the additive spray nozzles 118 and 602 are filled with the additives. In this time, the valves 122 and 606 are closed to stop the nebulizer gas. The valves 106 and 122 are opened at a time 7*a* when the signal intensity of the measurement target substance C requiring the additive X exceeds the threshold, and the additive X is sprayed from the additive spray nozzle 118 to the measurement target substance ion. The valves 106 and 122 are closed at a time 7*b* when the signal intensity of the measurement target substance C becomes below the threshold, and the spraying of the additive X is stopped. Next, the valves 603 and 606 are opened at a time 7*c* when the signal intensity of the measurement target substance D requiring the additive Y exceeds the threshold, and the additive Y is sprayed from the additive spray nozzle 602 to the measurement target substance ion. The valves 603 and 606 are closed at a time 7*d* when the signal intensity of the measurement target substance D becomes below the threshold, and the spraying of the additive Y is stopped. The spraying of the additive X or the additive Y is stopped at the time when the additive is not required, so that the apparatus can be prevented from being contaminated with the additive X and the additive Y.

Figure 8:
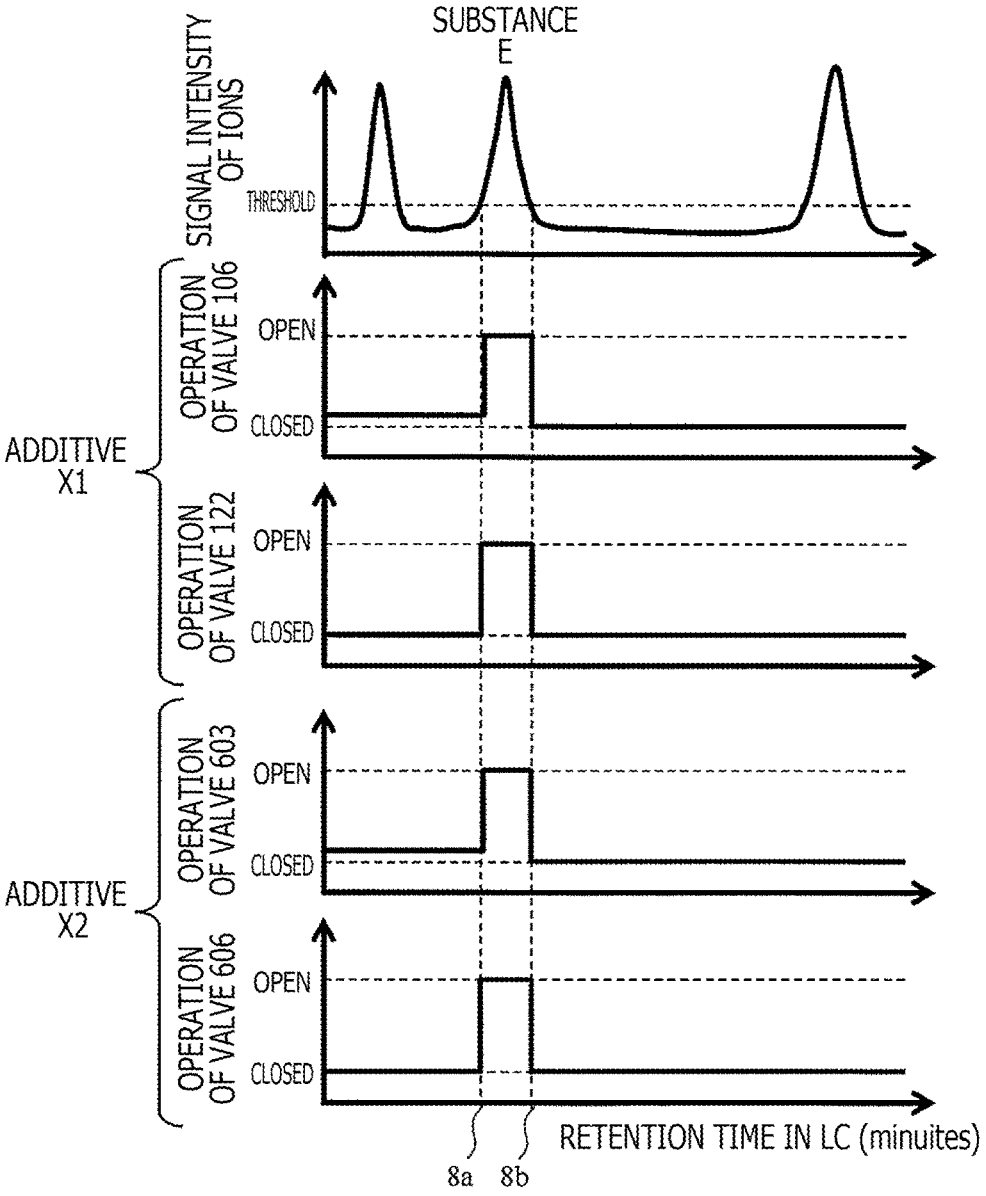
FIG. 8 is a diagram illustrating an example of a switching sequence of additives.
Figure 9:
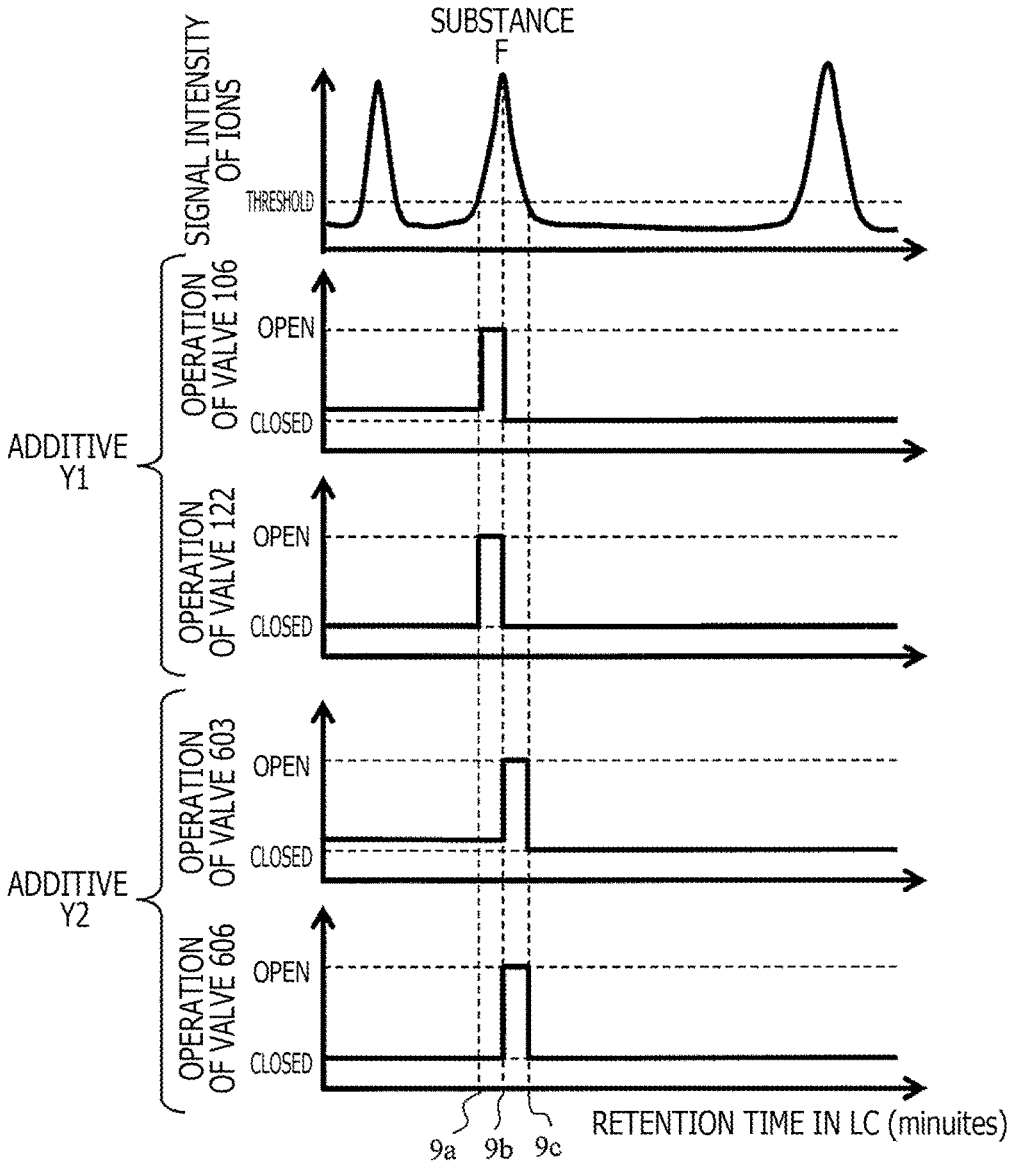
FIG. 9 is a diagram illustrating an example of a switching sequence of additives.

As illustrated in FIG. 8 or 9, a switching sequence other than that illustrated in FIG. 7 may be used for the timing of switching the additives.

FIG. 8 is a diagram illustrating an example of a switching sequence of additives in a case where an additive X1 and an additive X2 are sprayed simultaneously to a measurement target substance E that requires the additive. In this example, in order to quickly switch the additive sprays, the valves 106 and 603 are not fully closed and the additive X1 and the additive X2 are caused to flow continuously at low flow rates such that the additive spray nozzles 118 and 602 are filled with the additives. In this time, the valves 122 and 606 are closed to stop the nebulizer gas. At a time 8*a* when the signal intensity of the measurement target substance E requiring the additive exceeds the threshold, the valves 106 and 122 are opened to spray the additive X1 from the additive spray nozzle 118 to the measurement target substance ion, and the valves 603 and 606 are opened to spray the additive X2 to the measurement target substance ion. Thereafter, at a time 8*b* when the signal intensity of the measurement target substance E becomes below the threshold, the valves 106 and 122 are closed to stop the spraying of the additive X1, and the valves 603 and 606 are closed to stop the spraying of the additive X2.

FIG. 9 illustrates an example in which a plurality of additive sprays are controlled to sequentially operate at a time when the same measurement target substance F is measured. In other words, illustrated is an example of a switching sequence in which an additive Y1 is sprayed to the measurement target substance F in the first half of the retention time when the measurement target substance F is being detected, and an additive Y2 is sprayed to the same measurement target substance F in the last half of the retention time. In this example, in order to quickly switch the additive sprays, the valves 106 and 603 are not fully closed and the additive Y1 and the additive Y2 are caused to flow continuously at low flow rates such that the additive spray nozzles 118 and 602 are filled with the additives. In this time, the valves 122 and 606 are closed to stop the nebulizer gas. At a time 9*a* when the signal intensity of the measurement target substance F requiring the additive Y1 exceeds the threshold, the valves 106 and 122 are opened to spray the additive Y1 to the measurement target substance ion. For example, at a time 9*b* when the signal intensity of the measurement target substance F takes a peak, the valves 106 and 122 are closed and the valves 603 and 606 are opened to thereby spray the additive Y2 to the measurement target substance ion. Thereafter, at a time 9*c* when the signal intensity of the measurement target substance F becomes below the threshold, the valves 603 and 606 are closed to stop the spraying of the additive Y2.

When the additive X1 and the additive X2 are sprayed simultaneously as illustrated in FIG. 8, it is not necessary to prepare an additional additive spray nozzle dedicated for the mixture of the additive X1 and the additive X2, so that the structure of the apparatus can be simplified. Further, when an additive Y1 is sprayed to the measurement target substance in the first half of the retention time in which the measurement target substance is being detected and an additive Y2 is sprayed to the same measurement target substance in the last half of the retention time as illustrated in FIG. 9, it is possible that two kinds of ions, that is, the measurement target substance ion reacted with the additive Y1 and the measurement target substance ion reacted with the additive Y2, can be measured in a single measurement. These two ions are different from each other in mass-to-charge ratio m/z, so that two kinds of data different from each other can be obtained by the differential ion mobility separator 116 and the mass spectrometer 117. Thus, more information on the measurement target substance can be obtained, and the identification accuracy of the measurement target substance can be improved.

Here, illustrated in FIGS. 7, 8, and 9 are examples in which the spray-starting timing or the spray-stopping timing of each of the additive sprays are controlled by comparing the signal intensity of the ions detected by the detector 130 of the mass spectrometer 117 with the preset threshold. The control of the spraying and stopping of each additive spray may be performed by the control personal computer in a manner that the control personal computer stores in advance therein the spraying-starting time and spray-stopping time of the each additive spray which are determined in accordance with the elapse time from the start of the analysis, and then the control personal computer performs the control on the basis of the stored information.

Embodiment 4

Figure 10:
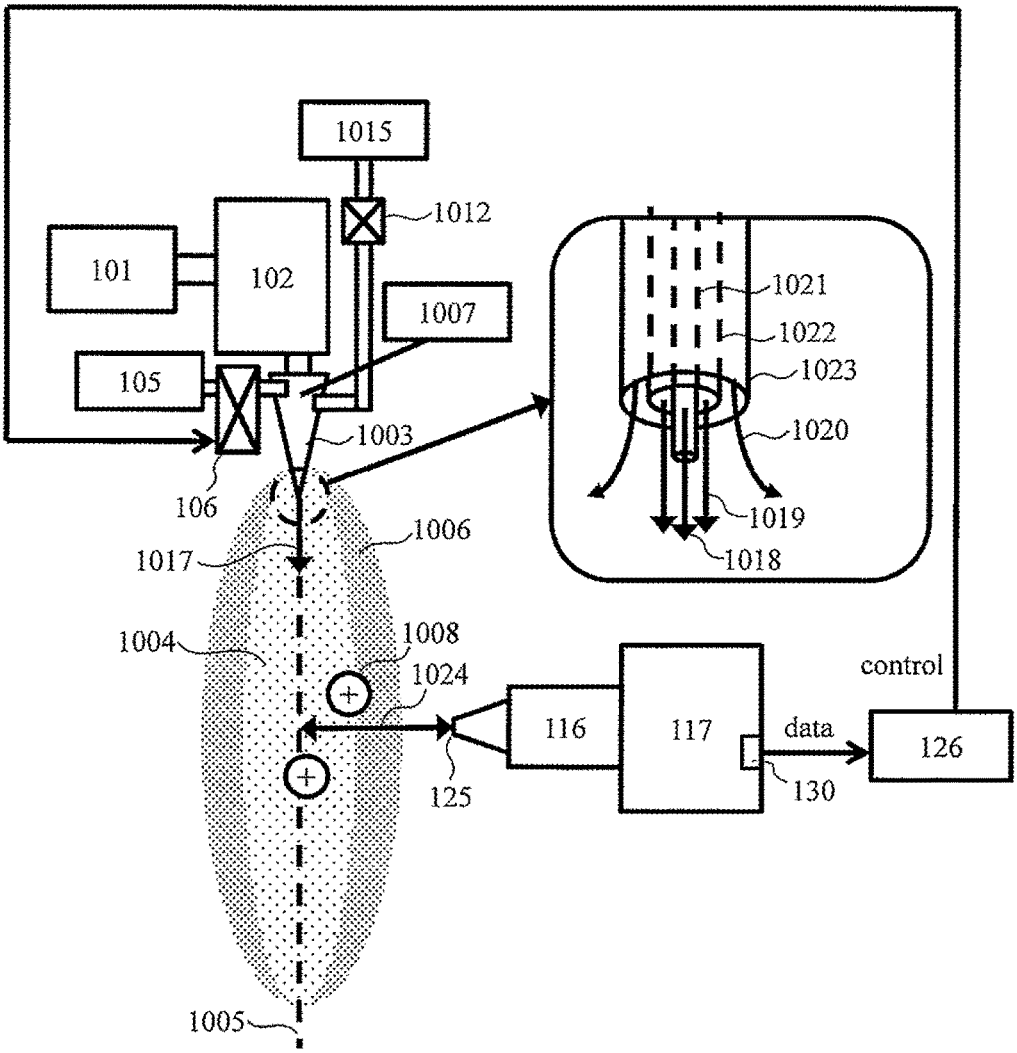
FIG. 10 is a schematic diagram illustrating still another embodiment of the ion analyzer.

FIG. 10 is a schematic diagram illustrating another embodiment of the ion analyzer. The example of this embodiment has a structure in which a sample and an additive are sprayed coaxially.

A measurement target substance contained in a liquid sample in a sample container 101 is separated by a liquid chromatography apparatus 102, and then sprayed by a coaxial spray nozzle 1003 after a retention time inherent to the substance. An additive container 105 contains therein a liquid containing the additive that alters the mass-to-charge ratio m/z of the measurement target substance ion. The liquid containing the additive flows through a valve 106 for adjusting the flow rate of the additive, and then sprayed by the coaxial spray nozzle 1003. Nebulizer gas needed for spraying flows through a valve 1012 for adjusting the flow rate, and then supplied from a gas cylinder 1015 to the coaxial spray nozzle 1003. The distal end of the coaxial spray nozzle 1003 is constituted by a cylindrical tube 1021 through which a liquid sample 1018 flows, a cylindrical tube 1022 through which a liquid 1019 containing the additive flows, and a cylindrical tube 1023 through which the nebulizer gas 1020 flows. By causing the liquid sample 1018, the liquid 1019 containing the additive, and the nebulizer gas 1020 to flow coaxially, the liquid sample 1018 and the liquid 1019 containing the additive are sprayed in the same direction of the vector 1017. A power source 1007 is the power source which applies a voltage for ionizing the liquid sample in accordance with the electro spray ionization method to the coaxial spray nozzle 1003. When the liquid sample 1018 and the liquid 1019 containing the additive are to be sprayed coaxially, supply lines for the nebulizer gas 1020 needed for spraying can be integrated into a single line, so that the spray nozzle can be miniaturized. Further, the consumption amount of the nebulizer gas 1020 can be reduced. Because it is not necessary to apply an ionization voltage to the liquid 1019 containing the additive, the circular tube 1022 partitioning between the liquid sample 1018 and the liquid 1019 containing the additive can be made from an insulation material. The voltage may also be applied to the liquid 1019 containing the additive.

When sprayed, a liquid sample 1004 has its solvent be volatilized to generate the measurement target substance ion by the electro spray ionization. The measurement target substance ion reacts with the sprayed additive 1006 to change its mass-to-charge ratio m/z. After reacted with the additive, the measurement target substance ion 1008 is transported to an ion introduction port 125 of the differential ion mobility separator 116 by a voltage applied to the ion introduction port 125. A vacuum pump installed in a mass spectrometer 117 sucks an airflow through the differential ion mobility separator 116, and the measurement target substance ion 1008 is transported together with the airflow into the differential ion mobility separator 116 and the mass spectrometer 117. After subjected to the mass spectrometry by the mass spectrometer 117, the measurement target substance ion is detected by the detector 130. The detection signal of the measurement target substance ion is taken into the control personal computer 126, and then control spraying and stopping of the additive by opening and closing the valve 106.

If the shortest distance 1024 between the straight line 1005 extending in the spraying direction of the coaxial spray nozzle 1003 and the ion introduction port 125 becomes shorter, the sensitivity becomes higher. Meanwhile, if the distance 1024 becomes longer, the contamination is reduced to enhance the robustness. The longer the distance 1024, the lower the sensitivity becomes. However, the sensitivity can be improved by raising the voltage applied to the ion introduction port 125 and thus collecting more measurement target substance ions 1008.

It should be noted that the present invention is not limited to the above embodiments but can include various modifications. For example, the above embodiments are described in detail in order to clearly explain the present invention, and are not necessarily limited to provide therein all the structure explained. Further, it is possible to replace a part of the structure of a certain embodiment with that of others, or to add a part of the structure of some embodiments to that of a certain embodiment. Moreover, for a part of the structure of each embodiment, addition, deletion, and/or replacement of the other structure can be made.

DESCRIPTION OF REFERENCE CHARACTERS

101 Sample container
102 Liquid chromatography apparatus
103 Sample spray nozzle
104 Gas cylinder
105 Additive container
107 Gas cylinder
109 Sprayed liquid sample
111 Sprayed additive
112 Discharging electrode
113 Measurement target substance ion
116 Differential ion mobility separator
117 Mass spectrometer
118 Additive spray nozzle
125 Ion introduction port
126 Control personal computer
130 Detector
401 Deflector electrode
602 Additive spray nozzle
604 Additive container
605 Gas cylinder
1003 Coaxial spray nozzle
1004 Sprayed liquid sample
1006 Sprayed additive
1008 Measurement target substance ion
1015 Gas cylinder

The invention claimed is:

1. An ion analyzer comprising:

a first spray unit for atomizing and spraying a liquid including a measurement target substance;

a second spray unit separate from the first spray unit for atomizing and spraying toward the sprayed measurement target substance a liquid containing an additive that reacts with the measurement target substance;

a separation analysis unit for separately analyzing an ion generated by a reaction between the measurement target substance and the additive;

a detector for detecting the ion that has been separately analyzed by the separation analysis unit; and a control unit for lowering a flow rate of the additive supplied to the second spray unit during a time when the additive is not necessary;

the second spray unit comprises:

at least one first piping for supplying another liquid comprising the additive;

at least one second piping for supplying spray gas to periphery of the another liquid, and wherein:

the additive is supplied to the first piping even during a time when the second spray unit is not spraying the additive; and wherein the control unit switches spraying and stopping of said additive by the second spray unit based on a flow rate of the spray gas supplied to said second piping.

2. The ion analyzer according to claim 1, wherein the separation analysis unit includes a mass spectrometer.

3. The ion analyzer according to claim 1, wherein the separation analysis unit includes an ion separator that separates ions in accordance with collision cross sections of the ions.

4. The ion analyzer according to claim 1, wherein, the control unit stores therein a time at which the measurement target substance is measured, and the control unit determines a time during which the additive is not necessary on the basis of the stored time.

5. The ion analyzer according to claim 1, wherein, the control unit monitors an ion signal intensity of the measurement target substance detected by the detector, and the control unit lowers the flow rate of the additive supplied to the second spray unit when the ion signal intensity of the measurement target substance is equal to or less than a preset threshold.

6. The ion analyzer according to claim 1, wherein the control unit sets a spray-starting time of the second spray unit before a time at which the measurement target substance is detected.

7. The ion analyzer according to claim 1, wherein the control unit causes the second spray unit to stop spraying of the additive during the time when the additive is not necessary.

8. The ion analyzer according to claim 1, wherein, the control unit monitors an ion signal intensity of the measurement target substance detected by the detector, and the control unit causes the second spray unit to spray the additive at a time when the ion signal intensity of the measurement target substance exceeds a preset threshold.

9. The ion analyzer according to claim 1, wherein, the control unit stores therein a time at which the measurement target substance is measured, and the control unit causes the second spray unit to spray the additive with using the stored time as a reference.

10. The ion analyzer according to claim 2, wherein the control unit changes parameters for the mass spectrometer at a time when the measurement target substance is measured in accordance with a measurement target substance whose mass-to-charge ratio has been changed by the additive.

11. The ion analyzer according to claim 1, wherein the ion analyzer comprises a plurality of the second spray units.

12. The ion analyzer according to claim 11, wherein the control unit performs a control for the plurality of second spray units to switch between spraying and stopping.

13. The ion analyzer according to claim 11, wherein the control unit causes the plurality of second spray units to operate simultaneously.

14. The ion analyzer according to claim 11, wherein the control unit causes the plurality of second spray units to operate sequentially at a time when a same measurement target substance is measured.

15. The ion analyzer according to claim 1, further comprising a deflector electrode for guiding to the separation analysis unit an ion of the measurement target substance that has reacted with the additive.

16. The ion analyzer according to claim 1, wherein a shortest distance between a straight line extending in a spraying direction of the second spray unit and an ion introduction port of the separation analysis unit is longer than a shortest distance between a straight line extending in an advancing direction of an ion that has been ionized by the ion source and the ion introduction port of the separation analysis unit.

17. The ion analyzer according to claim 1, wherein an angle formed by a vector defined in a direction in which the separation analysis unit sucks a gas and a vector defined in a direction in which the second spray unit sprays is equal to or greater than 90 degrees.

18. The ion analyzer according to claim 1, further comprising:

a first circular tube that allows a sample containing the measurement target substance to flow therethrough; and a second circular tube disposed coaxially with the first circular tube, the second circular tube allowing the additive to flow outside the first circular tube.

* * * * *